United States Patent [19]

Lundberg

[11] Patent Number: 4,662,789

[45] Date of Patent: May 5, 1987

[54] HYDROSTATIC COUPLING DEVICE

[75] Inventor: Thorsten Lundberg, Askim, Sweden

[73] Assignee: Götaverken Arendal AB, Göteborg, Sweden

[21] Appl. No.: 759,151

[22] Filed: Jul. 26, 1985

[30] Foreign Application Priority Data

Aug. 3, 1984 [SE] Sweden ..... 8403969

[51] Int. Cl.[4] ..... E02D 21/00; E02D 25/00

[52] U.S. Cl. ..... 405/205; 405/195; 405/204; 277/34

[58] Field of Search ..... 405/11-14, 405/195, 203-205, 207, 208, 211, 229, 230; 52/167; 114/229, 296; 277/34, 34.3, 34.6, 226; 49/477

[56] References Cited

U.S. PATENT DOCUMENTS

| | | | |
|---|---|---|---|
| 2,530,160 | 11/1950 | Finley | 49/477 X |
| 2,895,301 | 7/1959 | Casagrande et al. | 405/208 |
| 3,520,543 | 7/1970 | Etler et al. | 114/296 X |
| 4,052,861 | 10/1977 | Malone et al. | 405/195 |
| 4,191,495 | 3/1980 | Rivacoba et al. | 405/195 |
| 4,191,496 | 3/1980 | Becker | 405/229 |
| 4,469,335 | 9/1984 | Moore | 49/477 X |
| 4,474,508 | 10/1984 | Vos et al. | 405/195 |
| 4,522,532 | 6/1985 | Fedrick | 405/195 X |

FOREIGN PATENT DOCUMENTS

| | | | |
|---|---|---|---|
| 2386648 | 12/1978 | France | 405/195 |
| 2079826 | 1/1982 | United Kingdom | 405/207 |

*Primary Examiner*—Cornelius J. Husar
*Assistant Examiner*—Nancy J. Stodola
*Attorney, Agent, or Firm*—Wegner & Bretschneider

[57] ABSTRACT

A hydrostatic coupling device for rapidly releasing a first object immersed in water from another object resting on the sea bed. The device comprises a seal mounted in a groove in the first object, which in use will be pressed against the other object. The groove is formed as a closed loop delimiting a space at the surface of the first object facing the other object. The seal is formed as a membrane mounted along its sides and dividing the groove into an outer part, open to the ambient water, and an inner part, which via a pipe can be connected to a reservoir above the water surface. This reservoir maintains a liquid column pressure in the inner part, being a certain amount higher than the ambient water pressure. A pumping device removes water from the space delimited by the seal and both objects.

5 Claims, 3 Drawing Figures

HYDROSTATIC COUPLING DEVICE

BACKGROUND OF THE INVENTION

The present invention relates to a hydrostatic coupling device for rapidly releasable coupling of a first object immersed in water and another object affixed to the sea bed, and comprising a seal mounted into a groove in said first object, said seal, in use, being pressed toward said other object.

A locking device of this kind can be used for temporary coupling an offshore structure to a foundation on the sea bed. While producing oil in areas normally subjected to comparatively heavy seas it is disadvantageous to use floating production platforms, since it is difficult to maintain an accurate fixed position resulting in frequent interruptions of operations in order to prevent damage to equipment on the sea bed or to riser pipes connecting the platform to said equipment.

Conventional fixed platforms run the risk of being damaged from contact with large icebergs and/or adverse weather. Large icebergs can reach between 14 and 46 meters above the surface and have a draught of between 30 and 90 meters and it is therefore considered to be too expensive to build platforms strong enough to withstand relatively infrequent iceberg collisions.

A platform that can be temporarily affixed to the sea bed by means of rapidly releasable coupling devices would be able to maintain its normal duties during ordinary heavy seas, and be rapidly moved from its position to avoid a forceful hurricane or a large iceberg moving towards the production site.

The object of this invention is to attain a coupling device for this purpose, which is simple and can function reliably without frequent maintenance.

SUMMARY OF THE INVENTION

The coupling device according to the invention is characterized in that said groove forms a closed loop delimiting a space at the surface of said first object, turned towards said other object that said seal is formed as a membrane mounted along its sides and dividing the groove into an outer part, open to the ambient water, and an inner part which by way of a pipe can be connected to a reservoir above the water surface for maintaining a liquid column pressure in said inner part, extending ambient water pressure with a certain value, and that means are arranged to pump out water from the space which is delimited by said seal and both objects.

Preferably the space is connectable to the ambient water and the inner part is connectable to the atmosphere at a level below the surface by means of a valve in the pipe.

The inner part can also be connected to the ambient water at a level near the surface by means of another valve.

preferably the seal can swing from a non-pressurized, protected position in the groove to a pressurized position in contact with the radially inner flank of the groove and the other object.

According to another feature of the invention the seal is attached at the radially inner flank of the groove with the radially inner outside and at the radially outer flank with its radially outer inside.

DESCRIPTION

Figure 1:
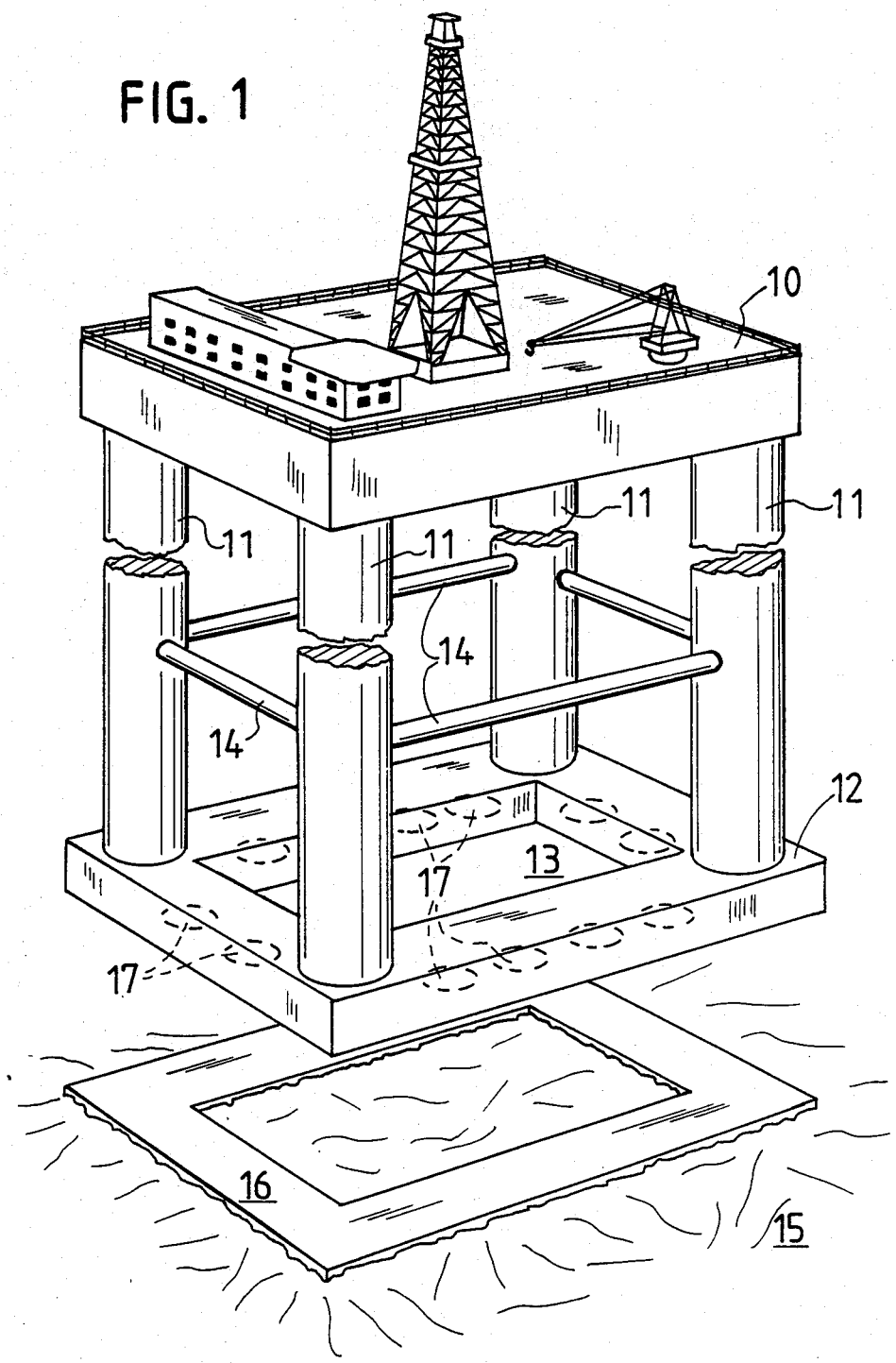
FIG. 1 is a perspective view of a platform used for production of oil on the sea bed and being equipped with a number of coupling devices according to the invention.

The platform in FIG. 1 comprises a work deck 10, which is supported by four legs 11 on a displacing body 12 forming a foursided frame structure with a central opening 13. The supporting legs 11 are connected by means of horizontal bracings 14, and are together with the body 12 provided with internal ballast tanks. By filling or dumping water from these tanks the vessel can alter its draught from the level shown in the figure to a position resting on the sea bed 15, e.g. at a depth of circa 100 meters.

A platform can stand firmly on level sea bed having enough ballast. Normally however, a platform standing on the sea bed sinks into mud and therefore it is not an easy operation to make the platform float up from the sea bed in case of an emergency.

The platform according to this invention is meant to rest on a foundation 16 that is affixed to the sea bed 15, and has a form corresponding with the underside of the body 12 and having a flat surface.

With enough ballast the platform could rest firmly on this foundation 16 and it could float up and move from the foundation fairly easy by dumping ballast. This dumping of ballast wold however take comparatively long time, which might be disastrous in an emergency.

In order to enable a rapid ascent of the platform from the foundation 16 the underside of the body 12 is equipped with several coupling devices 17. When the platform is going to be coupled to the foundation 16 it is moved over the foundation by means of its own, thruster propellers (not shown). The platform is aligned with the foundation 16, e.g. by means of optical or electronic position indicators, and the ballast tanks are filled until the platform rests on the foundation. After that the coupling devices 17 are activated in order to couple the platform to the foundation. As soon as the coupling is completed a certain amount of ballast can be dumped so that a certain buoyance is obtained in the platform. In an emergency the coupling device can thus be released, and the platform will automatically float up to a suitable height over the seabed 15 and move from the dangerous area.

Figure 2:
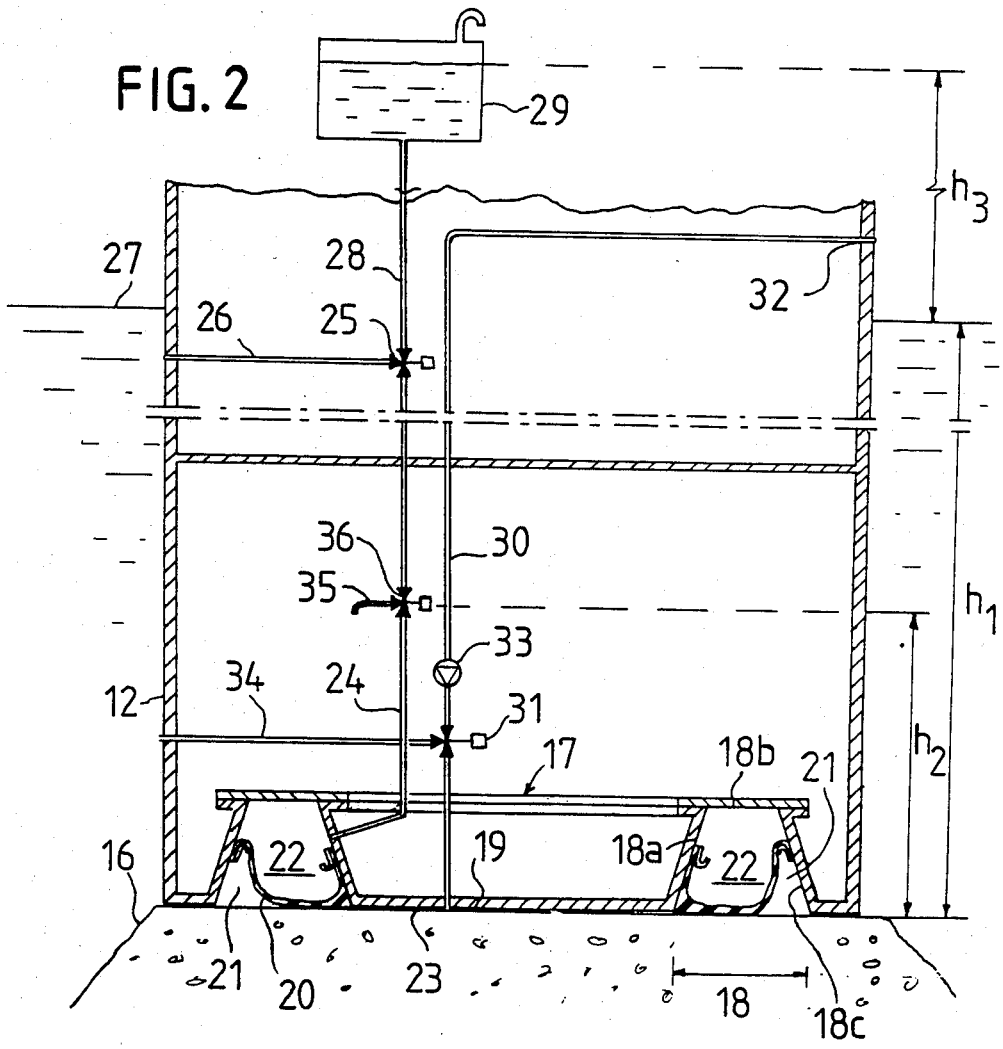
FIG. 2 is a diagrammatic representation of the elements comprising the coupling devices.

One of these couling devices 17 is more clearly shown in FIG. 2, and comprises a seal 20 mounted in a groove 18 on the underside of the body 12. This seal forms a membrane dividing the groove 18 into a part 21 open to the ambient water and an inner part 22. The groove 18 forms a closed loop, which can be circular or foursided and envelops a space 23 between said underside 19 and the surface of the foundation 16.

When the platform is lowered and rests on the foundation 16 the inner part 22 of the groove 18 can be filled with water through a pipe 24, a two-way valve 25 and a branch pipe 26 opening into the ambient water below the surface 27. Then the valve 25 can be shifted so that the inner part 22 is connected to a reservoir 29 positioned above the water level 27 through the pipe 24 and another branch pipe 28.

Figure 3:
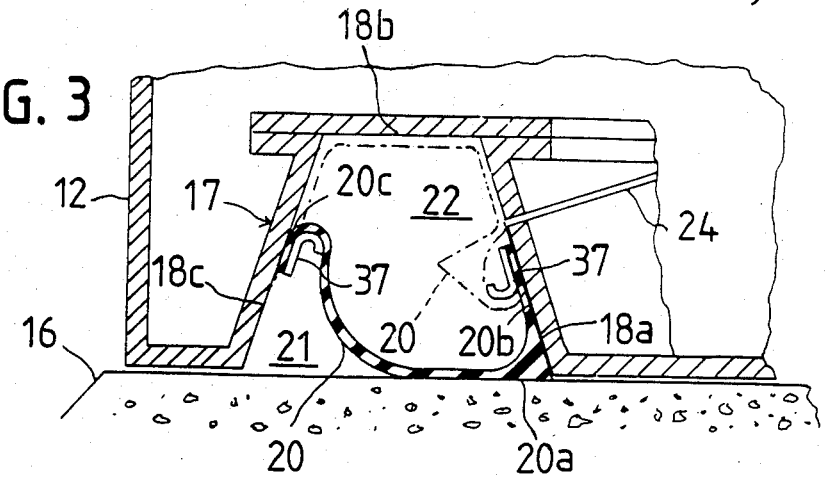
FIG. 3 shows on a larger scale the seal and its attachment in the coupling device.

The pressure $P_I$ prevailing in the inner part 22 of the groove 18 is now higher than the ambient water pressure $P_O$ by a value corresponding to the height $h_3$ of the liquid column in FIG. 3. Thus the seal 20 is pressed with a certain force against the surface of the foundation 16.

The space 23 surrounded by the seal 20 is connected to the atmosphere above the water surface 27 by way of a pipe 30, a two-way valve 31 and an outlet 32. Almost all water in the space 23 can be pumped out of the outlet 32 by means of a pump 33 in the pipe 30. In that way the pressure in the space 23 can be lowered to atmospheric. Thus the column of water acting upon the top of the body 12 above the space 23, and having equal diameter will exert a downward force, rigidly coupling the platform to the foundation 16.

When coupling in the various coupling devices 17 are engaged, a certain amount of ballast can be dumped from the platform, so that it will receive a buoyancy corresponding to a floating level, e.g. 10 meters above the sea bed 15.

The seal 20 has a wedge shaped part 20*a* at the radially inner flank 18*a* of the groove 18. This wedge shaped part will be forced by the overpressure in the inner part 22 of the groove into the gap between the foundation 16 and the underside 19 of the body 12, when the pressure in the space 23 is lowered by means of the pump 33 in the pipe 30, and will therefore enchance its sealing action.

A communication is opened by means of the valve 31 and a branch pipe 34 to the ambient water, when the platform needs to be moved from its position. The pressure in the space 23 will then be equal to the ambient water pressure and the downward force will stop acting on the top of the body 12. The platform will ascent rapidly from the foundation to its "survival draught level" and can move away from potentially dangerous icebergs by means of its thruster propellers.

Simultaneously with this safety releasing of coupling devices 17 must all riser systems (not shown in the drawings) also be released from the platform.

When the platform is to be released an evacuation conduit 35 is preferably opened by way of a valve 36 in order to limit stress on the seal 20 from overpressure when floating up, and letting this water enter the inner of the body 12. The ambient water pressure will then press the seal 20 up into the groove 18 until it rests against the surface 18*b*. In FIG. 3 dashlines show the seal 20 in this inactive position, in which it is protected from contact with the foundation 16, when the platform again is lowered to its working position. This turning of the seal 20 into its inactive position is faciliatated by the seal being mounted by means of fittings 37 at both flanks of the groove, so radially inner outward face 20*b* contacts the radially inner flank 18*a* of the groove 18, while its radially outer inward face 20*c* contacts the radially outer flank 18*c* of the groove. This mounting method enables the seal 20 to be brought into active or inactive positions with equal small resistance, even if its thickness is relatively great.

The fittings 37 are somewhat rounded to define a minimum possible curve radius for the seal 20, lessening the risk of a kerf accure in the seal.

The three valves 25, 31 and 36 and the pump 33 are preferably remotely controlled via electric or hydraulic means (not shown), having a control central on the deck 10 of the platform.

The invention is not limited to the example described above. Of course, numerous alternative embodiments of the present invention are possible within the scope of the present invention. The coupling device can be used on other marine structures than oil production platforms. The groove 1 can have other shapes than circular and the seal can be shaped differently.

What I claim is:

1. A hydrostatic coupling device for releasably holding a first object immersed in a body of water to a second object resting on the bottom of said body of water, comprising:

a groove in the shape of a closed loop defined by inner and outer side walls and a top wall formed in the face of said first object, said face being releasably held to said second object;

a membrane seal member disposed within said groove and having edges which are attached to said inner and outer side walls, said membrane seal member dividing said groove into an outer chamber which communicates with the surrounding water and an inner chamber which is separated from the surrounding water, said membrane seal member assuming a first position when the pressure in the inner chamber is greater than the pressure in the outer chamber, and assuming a second position when the pressure in the inner chamber is less than the pressure in the outer chamber;

means for pumping out water from the space within said inner side wall between said first and said second object;

a water reservoir located above the surface of said body of water and means to selectively connect said reservoir to said inner chamber to thereby move the membrane seal member into said first position which thereby causes said space to be sealed from the surrounding water; and means to selectively connect said inner chamber to an area of lower pressure than the surrounding water to thereby move the membrane seal member into said second position which thereby causes said space to communicate with the surrounding water.

2. A device as claimed in claim 1, further comprising means for selectively connecting said space with the surrounding water.

3. A device as claimed in claim 1, further comprising means to selectively connect said inner chamber with the water near the surface of said body of water.

4. A device as claimed in claim 1, wherein when said membrane seal member is in the first position, it contacts both the second object and the inner wall, to thereby seal said space from the surrounding water, and when said membrane seal member is in the second position, it is located in a protected position contacting the top wall of the groove.

5. A device as claimed in claim 1, wherein the edges of said membrane seal member are attached to the inner and outer walls with fittings having a rounded contact surface facing the membrane seal member.

* * * * *